US012173617B2

(12) United States Patent
Jiang et al.

(10) Patent No.: US 12,173,617 B2
(45) Date of Patent: Dec. 24, 2024

(54) TURBINE BLADE SQUEALER TIP WALL WITH CHAMFERED SURFACE

(71) Applicant: Siemens Energy Global GmbH & Co. KG, Munich (DE)

(72) Inventors: Nan Jiang, Charlotte, NC (US); Shantanu P. Mhetras, Charlotte, NC (US); Stephen Williamson, McAdenville, NC (US); John Harrington, Orlando, FL (US)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 18/337,533

(22) Filed: Jun. 20, 2023

(65) Prior Publication Data

US 2024/0035386 A1 Feb. 1, 2024

Related U.S. Application Data

(60) Provisional application No. 63/369,391, filed on Jul. 26, 2022.

(51) Int. Cl.
*F01D 5/18* (2006.01)
*F01D 5/14* (2006.01)
(Continued)

(52) U.S. Cl.
CPC ..... *F01D 5/18* (2013.01)

(58) Field of Classification Search
CPC . F01D 5/20; F01D 5/187; F01D 5/186; F01D 11/08; F01D 5/147; F01D 5/18; F01D 5/141; F01D 11/18; F01D 5/145; F01D 5/005; F01D 5/081; F01D 5/087; F01D 5/14; F01D 5/188; F01D 5/189; F01D 9/065; F01D 9/02; F05D 2260/202; F05D 2240/307; F05D 2220/32; F05D 2240/304; F05D 2260/22141; F05D 2240/306; F05D 2240/303; F05D 2240/305; F05D 2260/201; F05D 2250/192; F05D 2240/121; F05D 2240/122; F05D 2250/52; F05D 2250/70;
(Continued)

(56) References Cited

U.S. PATENT DOCUMENTS 8,157,504 B2 * 4/2012 Amaral ..... F01D 5/20 415/173.1
8,414,262 B2 * 4/2013 Hada ..... F01D 5/20 416/224
(Continued)

FOREIGN PATENT DOCUMENTS

CN 104775854 A 7/2015
DE 19944923 A1 3/2001

*Primary Examiner* — Eric J Zamora Alvarez

(57) ABSTRACT

A turbine blade includes a blade platform, a blade airfoil that extends from the blade platform toward a blade tip, the blade airfoil having a pressure side wall and a suction side wall joined at a blade leading edge and a blade trailing edge, a tip cap surface defined at an end of the blade airfoil facing the blade tip, a squealer tip wall that extends along a portion of the pressure side wall and a portion of the suction side wall from the tip cap surface to the blade tip and from the blade leading edge toward the blade trailing edge, and a chamfered surface formed as a part of the squealer tip wall at a region that is adjacent to the blade trailing edge.

19 Claims, 3 Drawing Sheets

(51) Int. Cl.
*F01D 5/20* (2006.01)
*F01D 5/28* (2006.01)

(58) Field of Classification Search
CPC ..... F05D 2260/2212; F05D 2260/2214; F05D 2260/221
See application file for complete search history.

(56) References Cited

U.S. PATENT DOCUMENTS

| | | | | |
|---|---|---|---|---|
| 8,684,691 | B2 * | 4/2014 | Lee | F01D 5/20 416/224 |
| 10,012,089 | B2 * | 7/2018 | Quach | F01D 5/147 |
| 11,643,934 | B2 * | 5/2023 | Krueckels | F01D 5/187 416/97 R |
| 2004/0151586 | A1 | 8/2004 | Chlus | |
| 2007/0059173 | A1 | 3/2007 | Lee et al. | |
| 2013/0104397 | A1 * | 5/2013 | Bunker | B23K 26/342 29/889.1 |
| 2017/0226866 | A1 * | 8/2017 | Nishimura | F01D 5/20 |
| 2020/0240276 | A1 * | 7/2020 | Williamson | F01D 5/20 |
| 2021/0340877 | A1 | 11/2021 | Kitada | |
| 2022/0170374 | A1 | 6/2022 | Kruechels | |

* cited by examiner

TURBINE BLADE SQUEALER TIP WALL WITH CHAMFERED SURFACE

BACKGROUND

A gas turbine engine typically includes a compressor section, a turbine section, and a combustion section disposed therebetween. The compressor section includes multiple stages of rotating compressor blades and stationary compressor vanes. The combustion section typically includes a plurality of combustors. The turbine section includes multiple stages of rotating turbine blades and stationary turbine vanes. Turbine blades and turbine vanes often operate in a high temperature environment and are internally cooled.

BRIEF SUMMARY

In one aspect, a turbine blade includes a blade platform, a blade airfoil that extends from the blade platform toward a blade tip, the blade airfoil having a pressure side wall and a suction side wall joined at a blade leading edge and a blade trailing edge, a tip cap surface defined at an end of the blade airfoil facing the blade tip, a squealer tip wall that extends along a portion of the pressure side wall and a portion of the suction side wall from the tip cap surface to the blade tip and from the blade leading edge toward the blade trailing edge, and a chamfered surface formed as a part of the squealer tip wall at a region that is adjacent to the blade trailing edge.

In one aspect, a turbine blade includes a blade platform, a blade airfoil that extends from the blade platform toward a blade tip, the blade airfoil having a pressure side wall and a suction side wall joined at a blade leading edge and a blade trailing edge, a tip cap surface defined at an end of the blade airfoil facing the blade tip, a squealer tip wall includes a suction side squealer tip wall that extends along the suction side wall from the tip cap surface to the blade tip and from the blade leading edge to the blade trailing edge, and a chamfered surface formed as a part of the suction side squealer tip wall at a region that is adjacent to the blade trailing edge.

BRIEF DESCRIPTION OF THE DRAWINGS

To easily identify the discussion of any particular element or act, the most significant digit or digits in a reference number refer to the figure number in which that element is first introduced.

DETAILED DESCRIPTION

Figure 1:
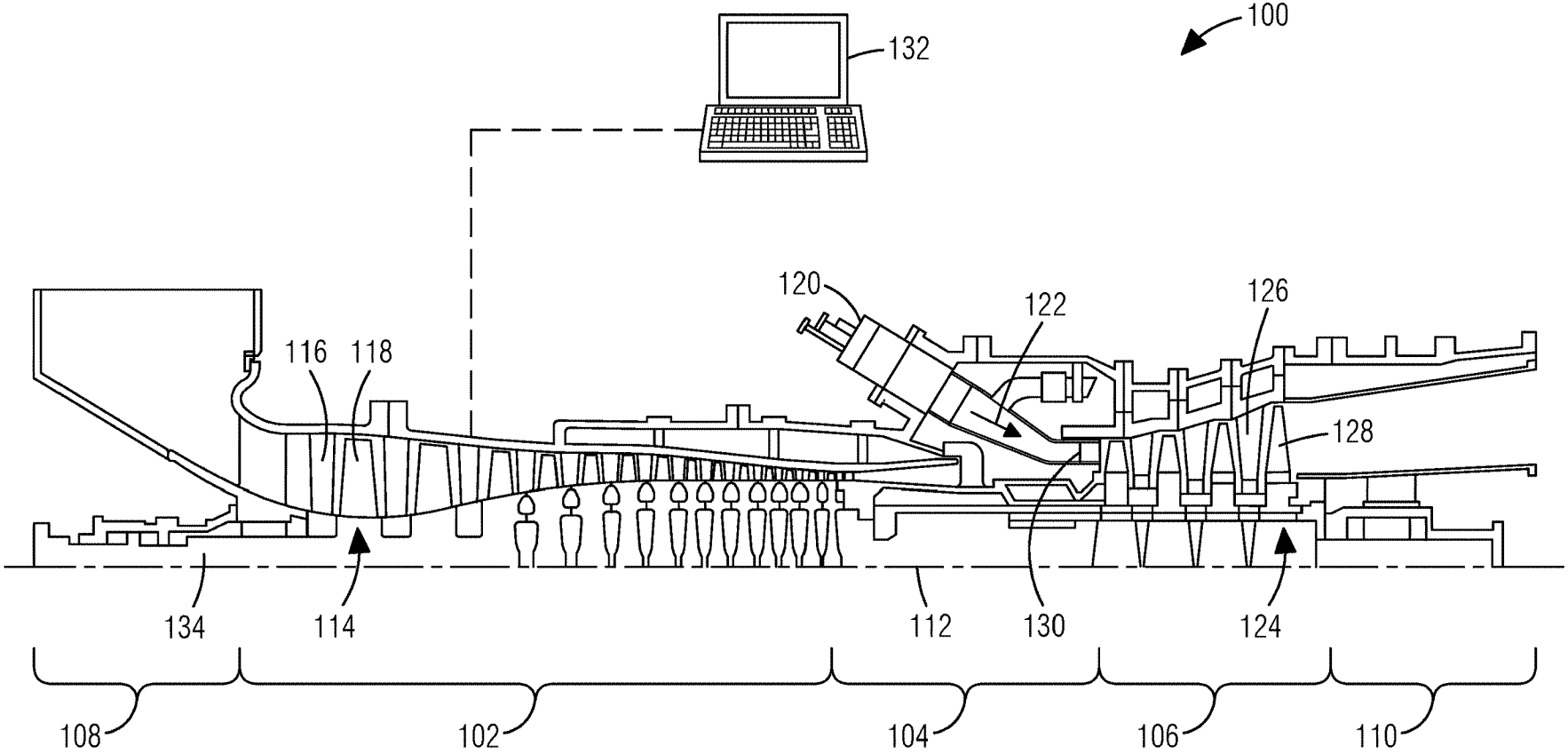
FIG. 1 is a longitudinal cross-sectional view of a gas turbine engine taken along a plane that contains a longitudinal axis or central axis.

Before any embodiments of the invention are explained in detail, it is to be understood that the invention is not limited in its application to the details of construction and the arrangement of components set forth in this description or illustrated in the following drawings. The invention is capable of other embodiments and of being practiced or of being carried out in various ways. Also, it is to be understood that the phraseology and terminology used herein is for the purpose of description and should not be regarded as limiting.

Various technologies that pertain to systems and methods will now be described with reference to the drawings, where like reference numerals represent like elements throughout. The drawings discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged apparatus. It is to be understood that functionality that is described as being carried out by certain system elements may be performed by multiple elements. Similarly, for instance, an element may be configured to perform functionality that is described as being carried out by multiple elements. The numerous innovative teachings of the present application will be described with reference to exemplary non-limiting embodiments.

Also, it should be understood that the words or phrases used herein should be construed broadly, unless expressly limited in some examples. For example, the terms "including", "having", and "comprising", as well as derivatives thereof, mean inclusion without limitation. The singular forms "a", "an", and "the" are intended to include the plural forms as well, unless the context clearly indicates otherwise. Further, the term "and/or" as used herein refers to and encompasses any and all possible combinations of one or more of the associated listed items. The term "or" is inclusive, meaning and/or, unless the context clearly indicates otherwise. The phrases "associated with" and "associated therewith" as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Furthermore, while multiple embodiments or constructions may be described herein, any features, methods, steps, components, etc. described with regard to one embodiment are equally applicable to other embodiments absent a specific statement to the contrary.

Also, although the terms "first", "second", "third" and so forth may be used herein to refer to various elements, information, functions, or acts, these elements, information, functions, or acts should not be limited by these terms. Rather these numeral adjectives are used to distinguish different elements, information, functions or acts from each other. For example, a first element, information, function, or act could be termed a second element, information, function, or act, and, similarly, a second element, information, function, or act could be termed a first element, information, function, or act, without departing from the scope of the present disclosure.

Also, in the description, the terms "axial" or "axially" refer to a direction along a longitudinal axis of a gas turbine engine. The terms "radial" or "radially" refer to a direction perpendicular to the longitudinal axis of the gas turbine engine. The terms "downstream" or "aft" refer to a direction along a flow direction. The terms "upstream" or "forward" refer to a direction against the flow direction.

In addition, the term "adjacent to" may mean that an element is relatively near to but not in contact with a further element or that the element is in contact with the further portion, unless the context clearly indicates otherwise. Further, the phrase "based on" is intended to mean "based, at least in part, on" unless explicitly stated otherwise. Terms "about" or "substantially" or like terms are intended to cover variations in a value that are within normal industry manufacturing tolerances for that dimension. If no industry standard is available, a variation of twenty percent would fall within the meaning of these terms unless otherwise stated.

FIG. 1 illustrates an example of a gas turbine engine 100 including a compressor section 102, a combustion section 104, and a turbine section 106 arranged along a central axis 112. The compressor section 102 includes a plurality of compressor stages 114 with each compressor stage 114 including a set of stationary compressor vane 116 or adjustable guide vanes and a set of rotating compressor blade 118. A rotor 134 supports the rotating compressor blade 118 for rotation about the central axis 112 during operation. In some constructions, a single one-piece rotor 134 extends the length of the gas turbine engine 100 and is supported for rotation by a bearing at either end. In other constructions, the rotor 134 is assembled from several separate spools that are attached to one another or may include multiple disk sections that are attached via a bolt or plurality of bolts.

The compressor section 102 is in fluid communication with an inlet section 108 to allow the gas turbine engine 100 to draw atmospheric air into the compressor section 102. During operation of the gas turbine engine 100, the compressor section 102 draws in atmospheric air and compresses that air for delivery to the combustion section 104. The illustrated compressor section 102 is an example of one compressor section 102 with other arrangements and designs being possible.

In the illustrated construction, the combustion section 104 includes a plurality of separate combustors 120 that each operate to mix a flow of fuel with the compressed air from the compressor section 102 and to combust that air-fuel mixture to produce a flow of high temperature, high pressure combustion gases or exhaust gas 122. Of course, many other arrangements of the combustion section 104 are possible.

The turbine section 106 includes a plurality of turbine stages 124 with each turbine stage 124 including a number of stationary turbine vanes 126 and a number of rotating turbine blades 128. The turbine stages 124 are arranged to receive the exhaust gas 122 from the combustion section 104 at a turbine inlet 130 and expand that gas to convert thermal and pressure energy into rotating or mechanical work. The turbine section 106 is connected to the compressor section 102 to drive the compressor section 102. For gas turbine engines 100 used for power generation or as prime movers, the turbine section 106 is also connected to a generator, pump, or other device to be driven. As with the compressor section 102, other designs and arrangements of the turbine section 106 are possible.

An exhaust portion 110 is positioned downstream of the turbine section 106 and is arranged to receive the expanded flow of exhaust gas 122 from the final turbine stage 124 in the turbine section 106. The exhaust portion 110 is arranged to efficiently direct the exhaust gas 122 away from the turbine section 106 to assure efficient operation of the turbine section 106. Many variations and design differences are possible in the exhaust portion 110. As such, the illustrated exhaust portion 110 is but one example of those variations.

A control system 132 is coupled to the gas turbine engine 100 and operates to monitor various operating parameters and to control various operations of the gas turbine engine 100. In preferred constructions the control system 132 is typically micro-processor based and includes memory devices and data storage devices for collecting, analyzing, and storing data. In addition, the control system 132 provides output data to various devices including monitors, printers, indicators, and the like that allow users to interface with the control system 132 to provide inputs or adjustments. In the example of a power generation system, a user may input a power output set point and the control system 132 may adjust the various control inputs to achieve that power output in an efficient manner.

The control system 132 can control various operating parameters including, but not limited to variable inlet guide vane positions, fuel flow rates and pressures, engine speed, valve positions, generator load, and generator excitation. Of course, other applications may have fewer or more controllable devices. The control system 132 also monitors various parameters to assure that the gas turbine engine 100 is operating properly. Some parameters that are monitored may include inlet air temperature, compressor outlet temperature and pressure, combustor outlet temperature, fuel flow rate, generator power output, bearing temperature, and the like. Many of these measurements are displayed for the user and are logged for later review should such a review be necessary.

Figure 2:
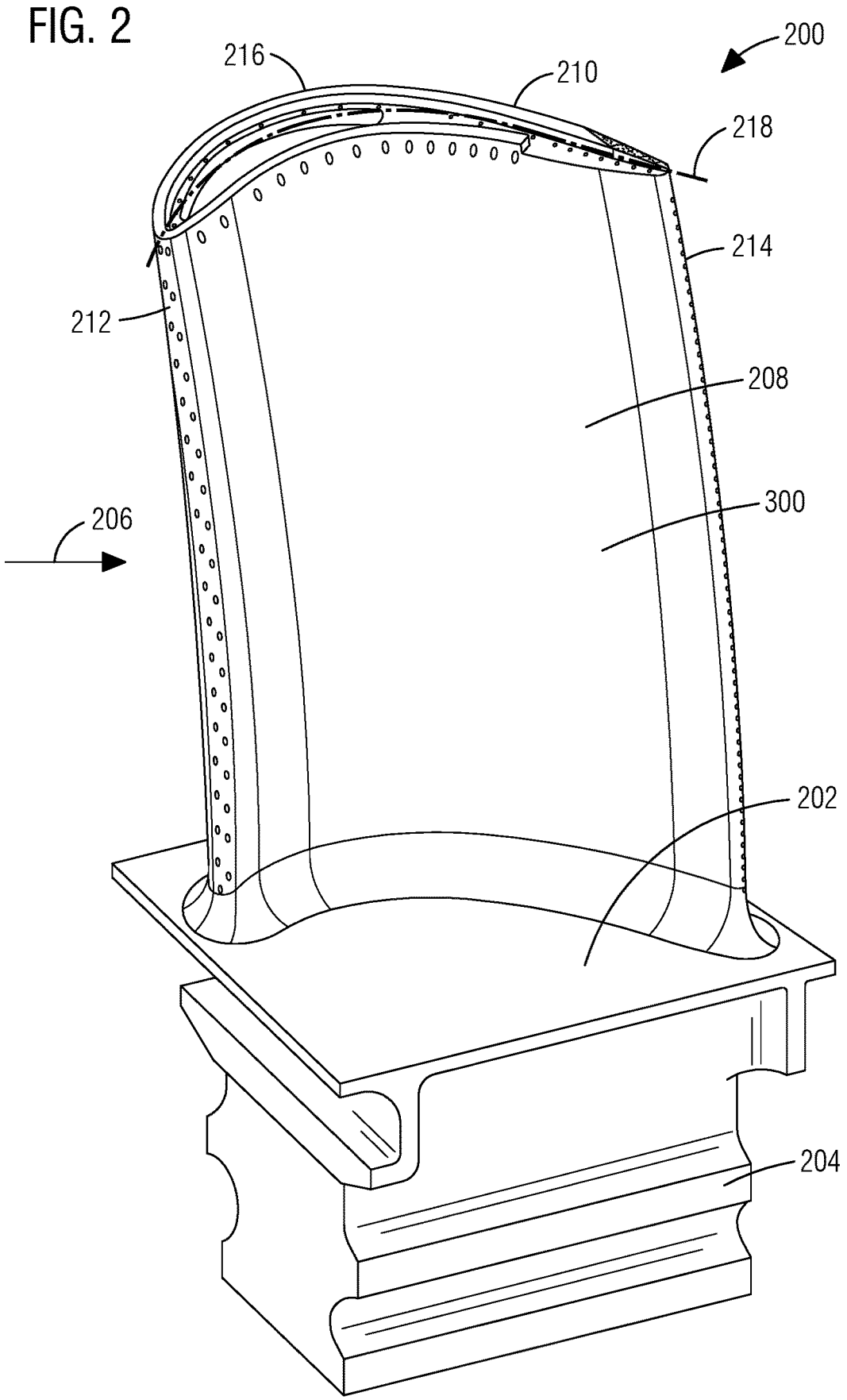
FIG. 2 is a perspective view of a turbine blade for use with the gas turbine engine shown in FIG. 1.

FIG. 2 illustrates a perspective view of a turbine blade 200. The turbine blade 200 or similar blades may be used in the gas turbine engine 100 as the rotating turbine blades 128.

The turbine blade 200 has a blade platform 202, a blade airfoil 300, and a blade root 204. The blade root 204 extends from a first side of the blade platform 202 toward the rotor 134 to engage the turbine blade 200 with the rotor 134.

The blade airfoil 300 extends from a second side of the blade platform 202, which is opposite to the first side, toward a blade tip 216. The blade airfoil 300 has a pressure side wall 208 and a suction side wall 210 that join together at a blade leading edge 212 and a blade trailing edge 214 with respect to a flow direction of the working fluid 206. A mean camber line 218 of the blade airfoil 300 is defined from the blade leading edge 212 to the blade trailing edge 214 passing through a midway points between the pressure side wall 208 and the suction side wall 210. The blade airfoil 300 is exposed in a stream of working fluid 206. The working fluid 206 may include the exhaust gas 122 from the combustor 120 shown in FIG. 1.

Figure 3:
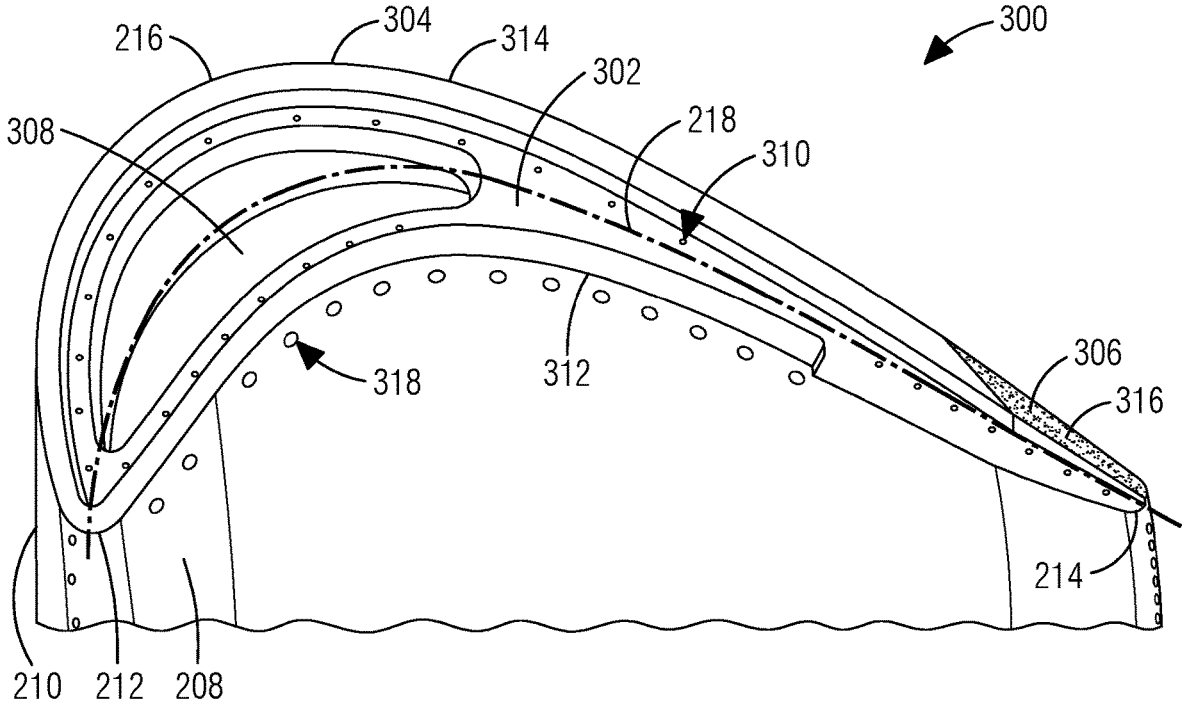
FIG. 3 is a portion of the perspective view of the turbine blade shown in FIG. 2 that better illustrates a blade tip.

FIG. 3 illustrates a portion of the perspective view of the turbine blade 200 shown in FIG. 2 that better illustrates the blade tip 216. The blade airfoil 300 has a tip cap surface 302 which is a surface at an end of the blade airfoil 300 facing the blade tip 216. The blade airfoil 300 has a first plurality of cooling holes 310 that are formed at the tip cap surface 302 and pass through the tip cap surface 302. The first plurality of cooling holes 310 are in flow connection with an interior of the blade airfoil 300. The blade airfoil 300 has an offset surface 308 that is offset a non-zero distance from the tip cap surface 302 toward the blade platform 202. The offset surface 308 is disposed at a region that is closer to the blade leading edge 212 than the blade trailing edge 214. The offset surface 308 may be parallel to the tip cap surface 302. In other constructions, the blade airfoil 300 may not have the offset surface 308 such that the tip cap surface 302 extends from the blade leading edge 212 to the blade trailing edge 214 and extends between the pressure side wall 208 and the suction side wall 210 at the end of the blade airfoil 300 facing the blade tip 216.

The blade tip 216 include a so-called "squealer tip". The squealer tip is defined by a squealer tip wall 304 that extends along a portion of the pressure side wall 208 and a portion of the suction side wall 210 from the tip cap surface 302 to the blade tip 216 and from blade leading edge 212 toward the blade trailing edge 214. The squealer tip wall 304 includes a pressure side squealer tip wall 312 and a suction side squealer tip wall 314. The pressure side squealer tip wall 312 extends along a portion of the pressure side wall 208. The suction side squealer tip wall 314 extends along a portion of the suction side wall 210. In the construction illustrated in FIG. 3, the pressure side squealer tip wall 312 extends along the pressure side wall 208 from the blade leading edge 212 to a location before the blade trailing edge 214. The suction side squealer tip wall 314 extends along the suction side wall 210 from the blade leading edge 212 to the blade trailing edge 214. In other constructions, the pressure side squealer tip wall 312 may extends along the pressure side wall 208 from the blade leading edge 212 to the blade trailing edge 214 and/or the suction side squealer tip wall 314 may extends along the suction side wall 210 from the blade leading edge 212 to a location before the blade trailing edge 214.

The blade airfoil 300 has a second plurality of cooling holes 318 that are formed at the squealer tip wall 304 and pass through the squealer tip wall 304. The second plurality of cooling holes 318 are arranged at the pressure side squealer tip wall 312 and pass through the pressure side squealer tip wall 312 and are arranged at the suction side squealer tip wall 314 and pass through the suction side squealer tip wall 314. The second plurality of cooling holes 318 are in flow connection with the interior of the blade airfoil 300.

A chamfered surface 306 is formed as a part of the squealer tip wall 304. In the construction illustrated in FIG. 3, the portion of the squealer tip wall 304 that is adjacent to the blade trailing edge 214 is chamfered to form the chamfered surface 306. As used herein "adjacent" means that the chamfered surface 306 begins at the blade trailing edge 214 or within 10% of a length of the mean camber line 218 from the blade trailing edge 214. The chamfered surface 306 may extend along the squealer tip wall 304 from the blade trailing edge 214 toward the blade leading edge 212 for a distance between 1-30% of the length of the mean camber line 218. The length of the mean camber line 218 is defined as the curved length of the mean camber line 218 from the blade trailing edge 214 to the blade leading edge 212. The chamfered surface 306 may extend from the blade tip 216 toward the blade platform 202 for a distance between 1-5% of a height of the blade airfoil 300. The height of the blade airfoil 300 is defined from the blade platform 202 to the blade tip 216. The chamfered surface 306 may have any desired dimensions and orientations to meet design requirements of the gas turbine engine 100.

In the construction illustrated in FIG. 3, the chamfered surface 306 is formed as a part of the suction side squealer tip wall 314. A portion of the suction side squealer tip wall 314 that is adjacent to the blade trailing edge 214 is chamfered to form the chamfered surface 306. The chamfered surface 306 extends along the suction side squealer tip wall 314 from the blade trailing edge 214 toward the blade leading edge 212 for the distance between 1-30% of the length of the mean camber line 218. The chamfered surface 306 extends from the blade tip 216 on the suction side squealer tip wall 314 toward the blade platform 202 for the distance between 1-5% of the height of the blade airfoil 300. In other constructions, the chamfered surface 306 may be formed as a part of the suction side squealer tip wall 314 and a part of the pressure side squealer tip wall 312 that are adjacent to the blade trailing edge 214. In yet other constructions, the chamfered surface 306 may be formed as a part of the squealer tip wall 304 adjacent to the blade trailing edge 214 of a blade airfoil 300 having the tip cap surface 302 extending from the blade leading edge 212 to the blade trailing edge 214 without the offset surface 308.

A thermal barrier coating 316 is applied to the chamfered surface 306. In other constructions, the chamfered surface 306 may not be applied with the thermal barrier coating 316.

In operation, with reference to FIG. 2 and FIG. 3, cooling flow exits the blade airfoil 300 from the interior of the blade airfoil 300 through the first plurality of cooling holes 310 disposed at the tip cap surface 302 and through the second plurality of cooling holes 318 disposed at the squealer tip wall 304. The tip cap surface 302 is stepped radially up from the offset surface 308 so that the cooling flow exits the blade airfoil 300 at a location that is closer to the blade tip 216. Cooling to the blade tip 216 is thus improved. The chamfered surface 306 at the region of the blade trailing edge 214 of the squealer tip wall 304 reduces metal temperature of the blade airfoil 300 at this region. The chamfered surface 306 is coated with the thermal barrier coating 316. The arrangement of the chamfered surface 306 with the thermal barrier coating 316 reduces the degradation and distress at the trailing edge 214 of the squealer tip wall 304. Durability of the turbine blade 200 is thus improved.

Although an exemplary embodiment of the present disclosure has been described in detail, those skilled in the art will understand that various changes, substitutions, variations, and improvements disclosed herein may be made without departing from the spirit and scope of the disclosure in its broadest form.

None of the description in the present application should be read as implying that any particular element, step, act, or function is an essential element, which must be included in the claim scope: the scope of patented subject matter is defined only by the allowed claims. Moreover, none of these claims are intended to invoke a means plus function claim construction unless the exact words "means for" are followed by a participle.

LISTING OF DRAWING ELEMENTS

100: gas turbine engine
102: compressor section
104: combustion section
106: turbine section
108: inlet section
110: exhaust portion
112: central axis
114: compressor stage
116: stationary compressor vane
118: rotating compressor blade
120: combustor
122: exhaust gas
124: turbine stage
126: stationary turbine vane
128: rotating turbine blade
130: turbine inlet
132: control system
134: rotor
200: turbine blade
202: blade platform
204: blade root
206: working fluid
208: pressure side wall
210: suction side wall
212: blade leading edge
214: blade trailing edge
216: blade tip
218: mean camber line
300: blade airfoil
302: tip cap surface

304: squealer tip wall
306: chamfered surface
308: offset surface
310: cooling hole
312: pressure side squealer tip wall
314: suction side squealer tip wall
316: thermal barrier coating
318: cooling hole

What is claimed is:

1. A turbine blade comprising:

a blade platform;

a blade airfoil that extends from the blade platform toward a blade tip, the blade airfoil having a pressure side wall and a suction side wall joined at a blade leading edge and a blade trailing edge;

a tip cap surface defined at an end of the blade airfoil facing the blade tip;

a squealer tip wall that extends along a portion of the pressure side wall and a portion of the suction side wall from the tip cap surface to the blade tip and from the blade leading edge toward the blade trailing edge, wherein the squealer tip wall comprises a suction side squealer tip wall that extends along the suction side wall from the blade leading edge to the blade trailing edge, the suction side squealer tip wall defining a suction side squealer tip surface; and a chamfered surface formed as a part of the squealer tip wall only at a region that is adjacent to the blade trailing edge and extends to the suction side wall.

2. The turbine blade of claim 1, wherein the chamfered surface extends along the squealer tip wall from the blade trailing edge toward the blade leading edge for a distance between 1-30% of a length of a mean camber line of the blade airfoil.

3. The turbine blade of claim 1, wherein the chamfered surface extends from a blade tip toward the blade platform for a distance between 1-5% of a height of the blade airfoil.

4. The turbine blade of claim 1, wherein a thermal barrier coating is applied to the chamfered surface.

5. The turbine blade of claim 1, wherein the squealer tip wall comprises a pressure side squealer tip wall that extends along the pressure side wall from the blade leading edge to a location before the blade trailing edge.

6. The turbine blade of claim 1, wherein the chamfered surface is formed as a part of the suction side squealer tip wall.

7. The turbine blade of claim 1, further comprising an offset surface that is offset a non-zero distance from the tip cap surface toward the blade platform, wherein the tip cap surface is a planar surface from the blade leading edge to the blade trailing edge, wherein the blade airfoil comprises a cavity that extends through the planar tip cap surface to the offset surface, and wherein a distance from a trailing edge side surface of the cavity to the blade leading edge along a mean camber line of the blade airfoil is shorter than a distance from the trailing edge side surface of the cavity to the blade trailing edge along the mean camber line of the blade airfoil.

8. The turbine blade of claim 7, wherein the offset surface is disposed at a region that is closer to the blade leading edge than the blade trailing edge.

9. The turbine blade of claim 1, wherein a first plurality of cooling holes are arranged at the tip cap surface and pass through the tip cap surface.

10. The turbine blade of claim 1, wherein a second plurality of cooling holes are arranged at the squealer tip wall and pass through the squealer tip wall.

11. A turbine blade comprising:

a blade platform;

a blade airfoil that extends from the blade platform toward a blade tip, the blade airfoil having a pressure side wall and a suction side wall joined at a blade leading edge and a blade trailing edge;

a tip cap surface defined at an end of the blade airfoil facing the blade tip;

a squealer tip wall comprising a suction side squealer tip wall that extends along the suction side wall from the tip cap surface to the blade tip and from the blade leading edge to the blade trailing edge, the suction side squealer tip wall defining a suction side squealer tip surface; and a chamfered surface formed as a part of the suction side squealer tip wall at a region that is adjacent to the blade trailing edge and extends to the suction side wall, a height of the chamfered surface defined from the tip cap surface to the chamfered surface decreasing from a pressure side edge of the suction side squealer tip wall to a suction side edge of the suction side squealer tip wall, wherein the chamfered surface extends along the suction side squealer tip wall from the blade trailing edge toward the blade leading edge for a distance between 1-30% of a length of a mean camber line of the blade airfoil.

12. The turbine blade of claim 11, wherein the chamfered surface extends from a blade tip toward the blade platform for a distance between 1-5% of a height of the blade airfoil.

13. The turbine blade of claim 11, wherein a thermal barrier coating is applied to the chamfered surface.

14. The turbine blade of claim 11, wherein the squealer tip wall comprises a pressure side squealer tip wall that extends along the pressure side wall from the tip cap surface to the blade tip and from the blade leading edge to a location before the blade trailing edge.

15. The turbine blade of claim 11, further comprising an offset surface that is offset a non-zero distance from the tip cap surface toward the blade platform, wherein the tip cap surface is a planar surface from the blade leading edge to the blade trailing edge, wherein the blade airfoil comprises a cavity that extends through the planar tip cap surface to the offset surface, and wherein a distance from a trailing edge side surface of the cavity to the blade leading edge along a mean camber line of the blade airfoil is shorter than a distance from the trailing edge side surface of the cavity to the blade trailing edge along the mean camber line of the blade airfoil.

16. The turbine blade of claim 15, wherein the offset surface is disposed at a region that is closer to the blade leading edge than the blade trailing edge.

17. The turbine blade of claim 11, wherein a first plurality of cooling holes are arranged at the tip cap surface and pass through the tip cap surface.

18. The turbine blade of claim 11, wherein a second plurality of cooling holes are arranged at the squealer tip wall and pass through the squealer tip wall.

19. A turbine blade comprising:

a blade platform;

a blade airfoil that extends from the blade platform toward a blade tip, the blade airfoil having a pressure side wall and a suction side wall joined at a blade leading edge and a blade trailing edge;

a tip cap surface defined at an end of the blade airfoil facing the blade tip;

a squealer tip wall comprising a suction side squealer tip wall that extends along the suction side wall from the tip cap surface to the blade tip and from the blade leading edge to the blade trailing edge, the suction side squealer tip wall defining a suction side squealer tip surface; and a chamfered surface formed as a part of the suction side squealer tip wall at a region that is adjacent to the blade trailing edge and extends to the suction side wall, a height of the chamfered surface defined from the tip cap surface to the chamfered surface decreasing from a pressure side edge of the suction side squealer tip wall to a suction side edge of the suction side squealer tip wall, wherein the squealer tip wall comprises a pressure side squealer tip wall that extends along the pressure side wall from the tip cap surface to the blade tip and from the blade leading edge to a location before the blade trailing edge.

* * * * *